US005621221A

United States Patent [19]

Shinohara et al.

[11] Patent Number: 5,621,221

[45] Date of Patent: Apr. 15, 1997

[54] TONER END DETECTION DEVICE AND METHOD

[75] Inventors: Tadashi Shinohara, Tokyo; Kouichi Noguchi, Machida; Eiichi Sasaki, Sagamihara; Kouichi Irie, Gotenba, all of Japan

[73] Assignee: Ricoh Company, Ltd., Tokyo, Japan

[21] Appl. No.: 361,950

[22] Filed: Dec. 22, 1994

[30] Foreign Application Priority Data

Dec. 22, 1993 [JP] Japan ..... 5-324036
Feb. 15, 1994 [JP] Japan ..... 6-018205

[51] Int. Cl.[6] ..... G03G 21/00

[52] U.S. Cl. ..... 250/576; 250/222.1; 118/691; 399/61

[58] Field of Search ..... 250/576, 575, 250/577, 573, 222.1, 221; 355/205, 246, 247, 203, 204, 206, 207, 208; 118/645, 688, 689, 691

[56] References Cited

U.S. PATENT DOCUMENTS

| | | | |
|---|---|---|---|
| 4,579,253 | 4/1986 | Shenier | 250/575 |
| 4,646,679 | 3/1987 | Ohno et al. | 118/691 |
| 4,750,015 | 6/1988 | Ogura et al. | 250/227.21 |
| 4,782,360 | 11/1988 | Iwamoto et al. | 355/4 |
| 4,792,825 | 12/1988 | Saito et al. | 355/300 |
| 5,035,198 | 7/1991 | Niito | 355/208 |
| 5,182,600 | 1/1993 | Hasegawa et al. | 355/246 |
| 5,258,819 | 11/1993 | Kimura et al. | 355/326 |

FOREIGN PATENT DOCUMENTS

| | | |
|---|---|---|
| 61-151576 | 7/1986 | Japan . |
| 61-180266 | 8/1986 | Japan . |
| 63-2087 | 1/1988 | Japan . |
| 63-78169 | 4/1988 | Japan . |
| 2-114281 | 4/1990 | Japan . |
| 4-361278 | 12/1992 | Japan . |
| 5-297711 | 11/1993 | Japan . |

*Primary Examiner*—Edward P. Westin
*Assistant Examiner*—John R. Lee
*Attorney, Agent, or Firm*—Woodcock Washburn Kurtz Mackiewicz & Norris

[57] ABSTRACT

An apparatus and method for detecting an empty condition of toner cartridges containing toner for copiers, fax machines, printers and the like is disclosed. The cartridges may be mounted to a rotary developing device. According to one embodiment, when a toner cartridge has been rotatably positioned to a developing position, an empty condition is detected by emitting light into the toner cartridge and detecting the light coming out of its bottom. To accomplish this detection, a light source and a light sensor are fixedly located near a bottom corner of the toner cartridge at the developing position. Light is emitted into the toner cartridge at a predetermined oblique angle with respect to a side wall of the toner cartridge. Light exits out from the bottom wall if a predetermined amount of toner does not exist in the toner cartridge. Due to the oblique angle, the distance between the light source and the light sensor is substantially reduced and provides an accurate measurement. This reduced distance also results in a smaller end detection system.

32 Claims, 12 Drawing Sheets

FIG. 11A
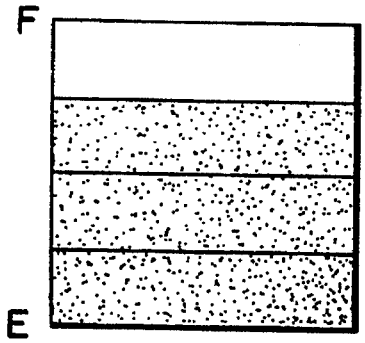
FIG. 11B
PLEASE WAIT FOR
TONER DETECTION
FIG. 12
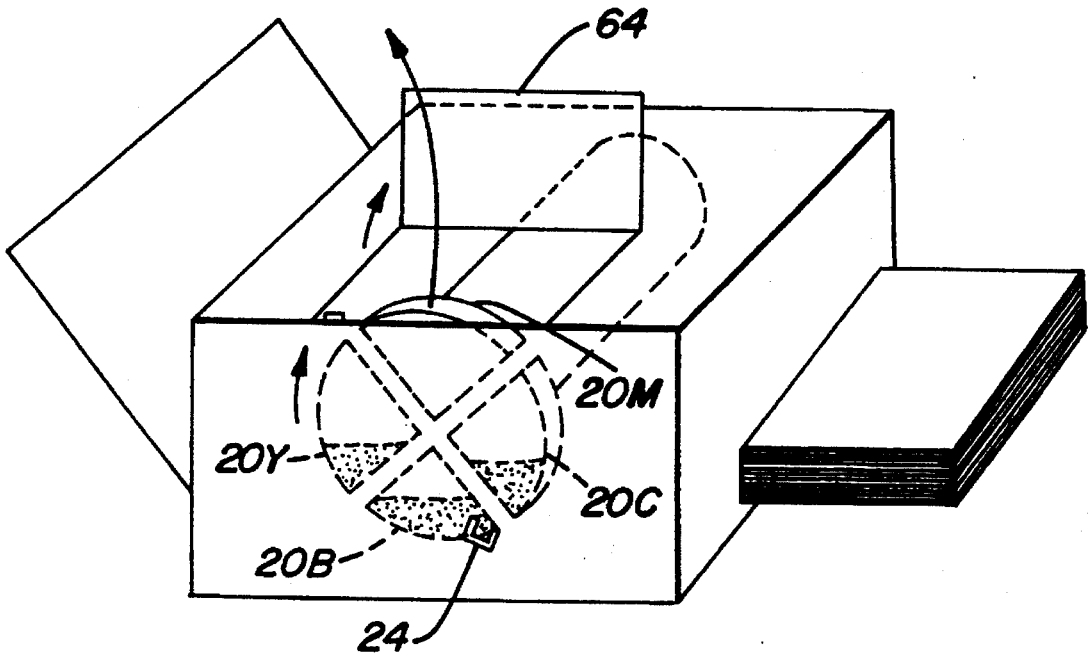

TONER END DETECTION DEVICE AND METHOD

FIELD OF THE INVENTION

The present invention is generally related to detection of an empty condition in a toner cartridge, and more particularly to the detection of an empty condition in toner cartridges that are mounted on a rotary developing device.

BACKGROUND OF THE INVENTION

In general, an image reproduction apparatus (i.e., a photocopier) reproduces images on an image-carrying medium by transferring toner or developer to the medium in relation to the characteristics of a given image. Such transfer is typically achieved through the use of a developing unit which places toner or developer on the image-carrying medium via a photoreceptor drum. To accomplish image transfer, the photoreceptor drum surface is first prepared by an electrophotographic image process to selectively accept toner in relation to the image characteristics. The developing unit then applies toner onto the photoreceptor drum via a developing roller. The toner applied to the photoreceptor drum is then transferred onto an image-carrying medium such as paper to reproduce the image. Further processing of the paper, for example, the application of heat, permanently adheres the toner to the paper.

In recent years, a rotary developing apparatus having multiple developing units has been proposed for color copiers, color printers and other image-forming apparatuses as disclosed, for example, in U.S. Pat. Nos. 4,782,360; 4,792,825; 5,258,819. In general, multiple independent developing units are housed in the rotary developing apparatus. Each of the multiple developing units is positioned around a cylindrical housing of the rotary developing apparatus, and each developing unit independently applies toner of a different color to a photoreceptor drum. To apply toner, only one independent developing unit is juxtaposed to the photoreceptor drum at a given time. Thus, for example, if four colors, such as yellow, magenta, cyan and black, are used, then four developing units (each containing one of these colors) are sequentially juxtaposed to the photoreceptor drum to apply toner of a particular color according to the characteristics of a desired image.

Each developing unit receives toner from a toner cartridge containing toner of a particular color. Although each toner cartridge may have the same toner capacity, depending upon the image characteristics, toner of one color may be consumed more quickly than toner of other colors. When one of the toner cartridges becomes empty, the operator must be notified so that he or she can replenish that toner or replace the empty toner cartridge with a new, full toner cartridge. Detection of an empty toner cartridge is known as "end detection" in the art of duplication machine technology.

Various attempts have been made to implement end detection. Attempts of particular relevance involve the use of light emitting and sensing devices. For example, Japanese Patent 61-180266 discloses the use of a light source and a light sensor mounted on the outside surfaces of a hopper to detect an empty condition in the hopper. However, this approach cannot practically be applied to a duplicating device that does not include a hopper. Japanese Patent 61-08/361,151,576 discloses an apparatus for detecting an empty condition in a toner cartridge in a duplicating device of the type wherein the toner cartridge is mounted to a rotary developing device. First and second pieces of optical fiber are placed on the inner bottom surface of the toner cartridge. When the toner cartridge is rotated adjacent to a light detection device, a light source emits light towards an end of the first optical fiber piece that faces the detection device. The emitted light is led to the other end of the first optical fiber and, if the cartridge is empty, the light is transmitted across a gap in the cartridge, and through the second optical fiber to a light sensor. On the other hand, if the cartridge is not empty, then there is no gap present, and the light is not transmitted to the second optical fiber. Thus, when the second optical fiber conveys the light to a light sensor, the toner cartridge is determined to be empty. The above-described optical sensing device requires a specially constructed toner cartridge, and the higher cost associated therewith is undesirable.

Japanese Patent 63-2087 discloses an optical toner end detection device which does not require a toner cartridge that has been specially adapted with additional elements. The system disclosed in this patent, however, requires a toner cartridge with a modified shape, i.e., a pinched bottom wall which provides a short cross sectional area. A light source and a light sensor are located across this pinched area for end detection. This system still requires a specially shaped toner cartridge.

Japanese Patent 2-114281 discloses an optical toner end detection system employing an ordinary toner cartridge. A light source and a light sensor are placed so as to transmit and receive light across the width of the toner cartridge as shown in FIG. 1. During an end detection interval, a brief burst of high intensity light is emitted by the light source. If light is detected by the light sensor, then the cartridge is determined to be empty. In addition, this reference discloses microprocessor-controlled flashing the light source.

In summary, the above-described attempts have required either a specially constructed toner cartridge with additional detection elements, a special toner cartridge shape, or a high intensity light source for accurate toner end detection. The additional elements lead to high manufacturing costs, the special shape hinders interchangeability of disposable toner cartridges, and the high intensity output shortens the life of the light source. In contrast, the current invention substantially overcomes these disadvantages without sacrificing accuracy in toner end detection.

SUMMARY OF THE INVENTION

An end detection apparatus according to one embodiment of the present invention comprises a toner cartridge mounted to a rotary developing device. The toner cartridge has a first wall, a second wall adjacent to the first wall, and a common bottom edge formed by the first wall and the second wall. At least a portion of each of the first and second walls, near the bottom edge, are light transmissive. A light source is located adjacent the first wall, near the bottom edge, for emitting a predetermined amount of light into the toner cartridge at a predetermined oblique angle with respect to the first wall and towards the second wall. A light sensor is located adjacent the second wall, near the bottom edge, for detecting the light exiting from the toner cartridge, whereby the light is detected in an empty condition.

According to a another embodiment of the invention, a plurality of toner cartridges are mounted to the rotary developing device. Each of the toner cartridges has the structure and properties described above. One of the toner cartridges which is rotatably positioned at a predetermined detection position is defined as a test toner cartridge. A light source is fixedly located adjacent the test toner cartridge for emitting a predetermined amount of light towards the first wall, near the bottom edge of the test toner cartridge, at a predetermined oblique angle with respect to the first wall and into the test toner cartridge towards the second wall of the test toner cartridge. A light sensor is fixedly located adjacent the bottom edge of the second wall of the test toner cartridge for detecting light exiting from the test toner cartridge, whereby light is detected in an empty condition. Each of the toner cartridges is rotatably positioned at the detection position for sequentially detecting the empty condition.

According to yet another embodiment of the invention, a toner cartridge is mounted to the rotary developing device, and the toner cartridge has a first and second wall, with at least a portion of the first and second walls being substantially light transmissive. A light source is located adjacent the first wall of the toner cartridge for emitting a predetermined amount of light at a predetermined frequency, into the toner cartridge. A light sensor is located adjacent the second wall for selectively detecting light exiting from the toner cartridge at the predetermined frequency, whereby light is detected in an empty condition.

According to a still a further embodiment of the invention, there is provided a method of detecting an empty condition in a toner cartridge for a rotary developing apparatus. According to this embodiment, the toner cartridge is mounted to the rotary developing device and shares a common axis of rotation therewith. The toner cartridge has the structure and properties described above. The method comprises the following steps: a) emitting light towards the first wall near the bottom edge at a predetermined oblique angle with respect to the first wall and towards the second wall near the bottom edge; b) measuring the light exiting through the second wall near the bottom edge; and, c) determining the status of the toner cartridge based upon the light measured in the step b.

According to still a further embodiment of the invention, there is provided another method of detecting an empty condition in a plurality of toner cartridges for a rotary developing apparatus. Again, the toner cartridges are mounted to the rotary developing device and share a common axis of rotation, and each of the toner cartridges has the structure and properties described above. This method comprises the steps of: a) positioning one of the toner cartridges at a predetermined detection position, the toner cartridge that is so positioned being defined as a test toner cartridge; b) emitting light towards the first wall near the bottom edge of the test toner cartridge at a predetermined oblique angle with respect to the first wall and towards the second wall near the bottom edge of the test toner cartridge; c) measuring the light exiting through the second wall near the bottom edge of the test toner cartridge; and, d) determining the status of the test toner based upon the light measured in the step c.

According to another embodiment of the invention, the toner cartridge has a first and second wall, and a method of end detection comprises the steps of: a) emitting light at a predetermined frequency towards the first wall into the toner cartridge towards the second wall; b) selectively measuring the light exiting through the second wall based upon the predetermined frequency; and, c) determining the status of the toner cartridge based upon the light measured in the step b.

According to a final embodiment of the invention disclosed herein, there is provided a method of determining the amount of toner remaining in a toner cartridge for a rotary developing apparatus, comprising the steps of: a) rotating the toner cartridge around the same axis as the rotary developing apparatus to one of a plurality of predetermined angular positions; b) emitting light towards the first wall of the toner cartridge when the toner cartridge has been positioned to the one of the predetermined angular positions; c) measuring the light exiting from the toner cartridge when the toner cartridge has been positioned to the one of the predetermined angular positions; d) rotating the toner cartridge to another one of the predetermined angular positions and repeating steps (b) and (c); (e) repeating step (d) until the toner cartridge has been rotated to all of the predetermined angular positions; and, f) determining the amount of remaining toner in the toner cartridge based upon each of the measurements taken in the step (c).

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 11A is an example of a status indicator for indicating the amount of toner remaining in a toner cartridge, as detected by the method of FIG. 7.

FIG. 11B is an example of another status indicator for indicating that a toner detection procedure is being performed.

FIG. 12 is a perspective view illustrating an empty toner cartridge at a predetermined position for replacement.

DETAILED DESCRIPTION OF TEE PREFERRED EMBODIMENT(S)

Figure 2:
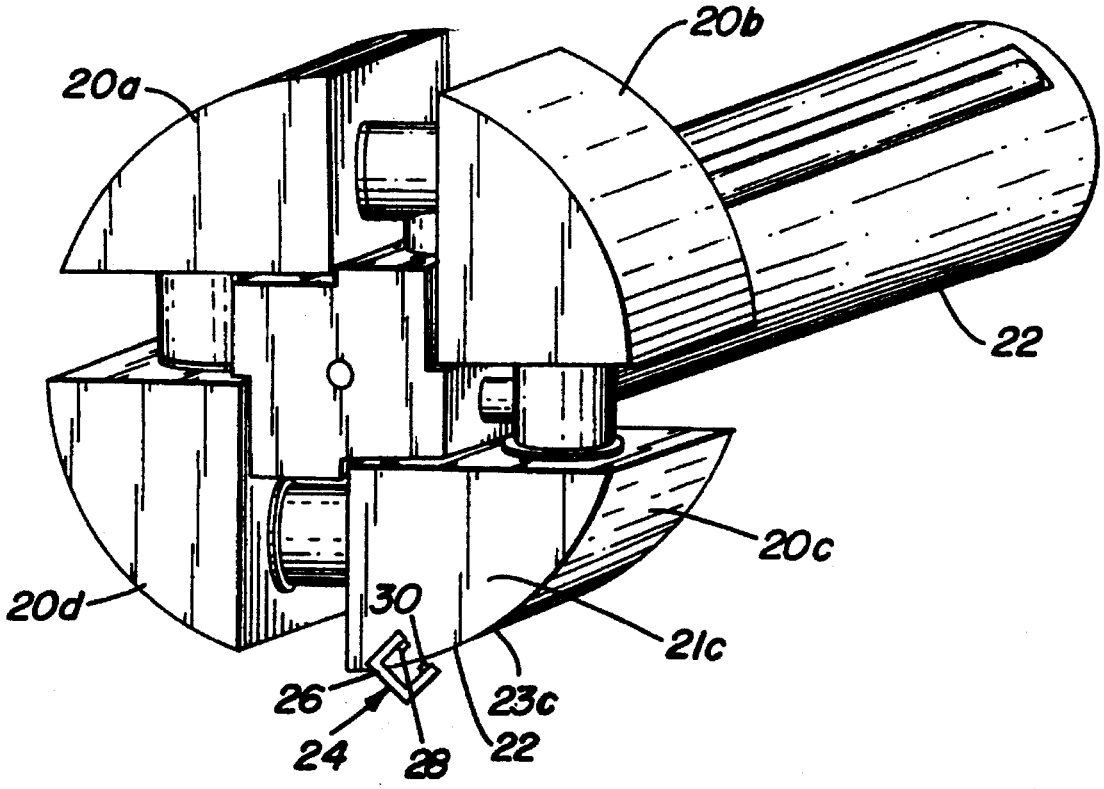
FIG. 2 is a perspective view of a rotary developing device having plural toner cartridges disposed on a common axis to the rotary developing device, and an end detection device, according to one embodiment of the invention.
Figure 9A:
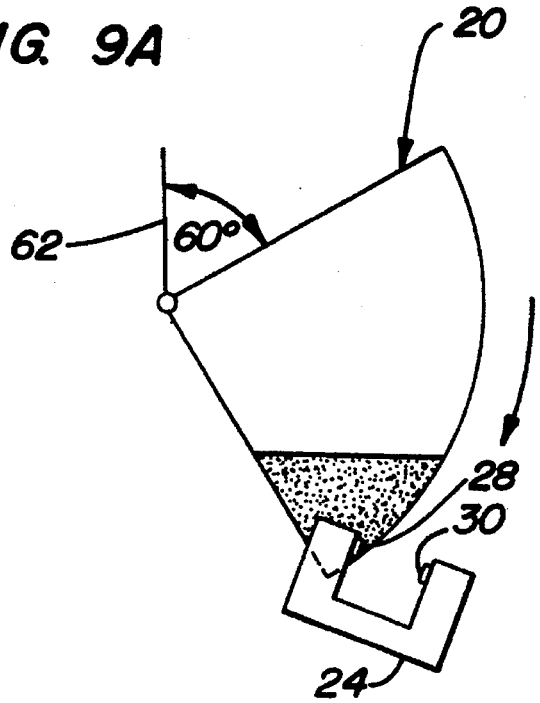
FIGS. 9A–9D are perspective views illustrating the toner cartridge positioned at four different predetermined angular positions, with respect to the detection device, as the method illustrated in FIG. 7 is performed.

Referring now to the drawings, wherein like reference numerals designate corresponding structure throughout the views, and referring in particular to FIG. 2, four toner cartridges 20*a*–20*d* are mounted to a side wall of a rotary developing device 22. These components are common for certain duplication apparati such as copiers, faxes, printers and the like. Toner cartridges 20*a*–20*d* each contain toner of a unique color such as black, cyan, magenta and yellow. These cartridges 22*a*–20*d* supply toner to a corresponding developing unit housed in the rotary developing device 22. The developing unit receiving toner from the toner cartridge 20*c* is positioned at a developing position for applying toner to a photoreceptor drum (not shown). The developing units do not in general consume each color toner at an equal rate mainly due to a varying amount of each color in images. Because of this unequal consumption, the toner level of each toner cartridge must be accurately monitored.

Still referring to FIG. 2, to detect the toner level, the current invention employs an optical apparatus for use with unmodified or conventional disposable toner cartridges mounted on a rotary developing device. According to one preferred embodiment, the optical detection apparatus 24 is fixedly positioned near the toner cartridge 20*c* at the developing position. However, the optical detection apparatus 24 may be positioned at the above described location with respect to any one of the four toner cartridges 20*a*–20*d*. One end of the optical detection apparatus 24 is positioned near a side wall 21*c* while the other end is positioned near a bottom wall 23*c* of toner cartridge 20*c* according to one preferred embodiment of the current invention. The empty condition in the toner cartridges 20*a*–20*d* is detected one toner cartridge at a time as the toner cartridges 20*a*–*d* are rotatably positioned at the developing position as will be later described.

Figure 3A:
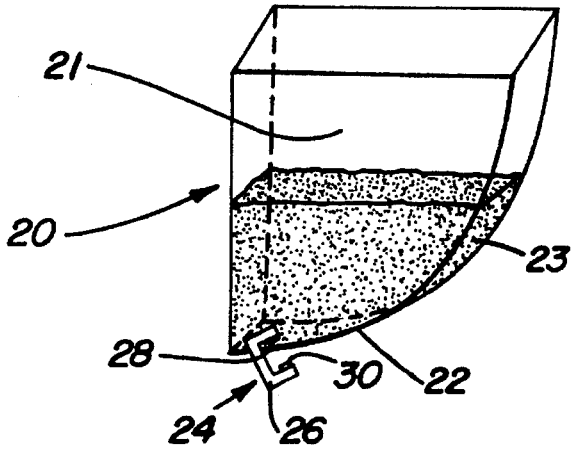
FIG. 3A is a more detailed perspective of one of the toner cartridges, and the detection device, of FIG. 1.

Referring to FIG. 3A, the detection device 24 and the toner cartridge 20 according to one preferred embodiment of the current invention are isolated. The detection device 24 includes a frame 26, a light source 28 such as a light emitting diode (LED) attached to one end of the frame 26 and a light sensor 30 such as a photodiode attached to the other end of the frame 26. To practice the current invention, the frame 26 does not have to be "C" shape but can be straight or flat. As shown in FIG. 3A, the frame 26 is positioned near a common edge formed by a side wall 21 and a bottom wall 23 of the toner cartridge 20.

Figure 3B:
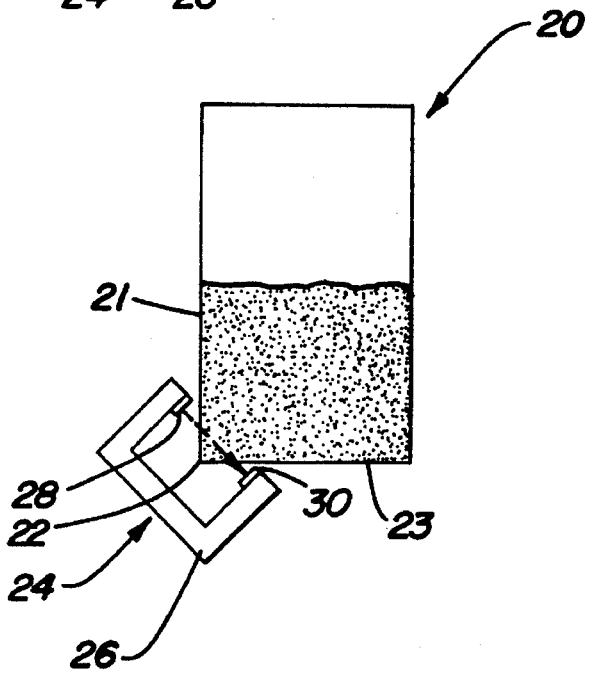
FIG. 3B illustrates a half-full toner cartridge and the detection device of FIG. 3A.
Figure 3C:
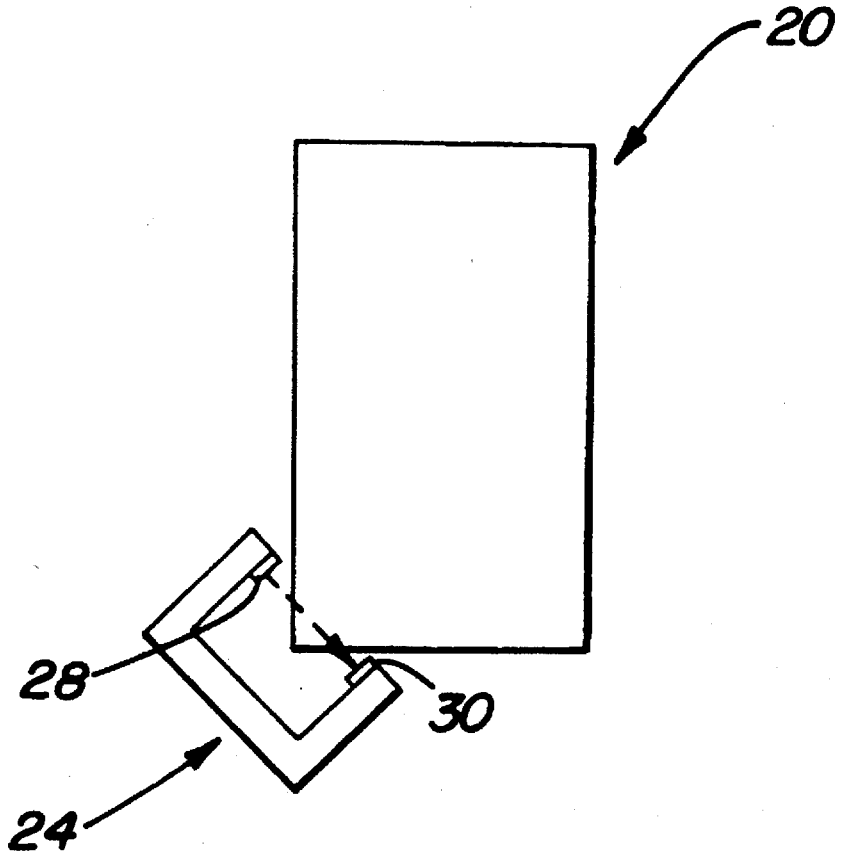
FIG. 3C illustrates an empty toner cartridge and the detection device of FIG. 3A.

Now referring to FIG. 3B, a cross sectional view of the toner cartridge 20 and the detection device 24 is shown in FIG. 3A. Light is emitted from the light source 28 towards the light sensor 30 through a substantially transparent toner cartridge 20. In the alternative, an opaque toner cartridge may have light transmitting portions. When the toner cartridge 20 is half-full as shown in FIG. 3B, the light emitted from the light source 28 does not reach the light sensor 30. Thus, no toner end condition is detected. On the other hand, when the toner cartridge is empty as shown in FIG. 3C, the emitted light from the light source 28 reaches the light sensor 30 to signify the toner end condition.

Figure 1:
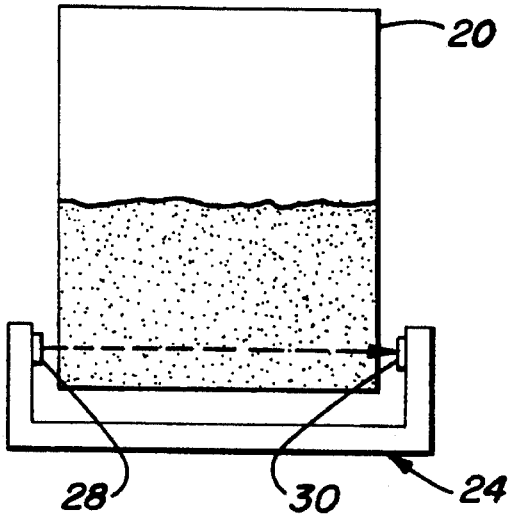
FIG. 1 PRIOR ART
FIG. 1 illustrates a prior art optical end detection device.

Still referring to FIG. 3B, one end of the frame 26 with the light source 28 is positioned above the bottom wall 23 and near the side wall 21 of the toner cartridge 20. The other end of the frame 26 with the light sensor 30 is positioned below the bottom wall 23 so that the light sensor 30 is aligned to a light path emitted by the light source 28 as indicated by a dotted arrow. In other words, the light source is obliquely angled with respect to the side wall 21 so that the length of its light path towards the bottom wall 23 is less than the width of the toner cartridge 20. In an alternative embodiment, although not shown, the light path is reversed so that the light source is positioned below the bottom wall 23 and the light is emitted towards the side wall 21 to be detected by the light sensor 30 positioned near the side wall 21 above the bottom wall 23. Regardless of the direction of the light path, the distance between the light source and the light sensor is substantially reduced according to the current invention in comparison to the distance shown in FIG. 1.

Still referring to FIG. 3B, the short distance for the light path between the light source 28 and light sensor 30 offers at least three specific advantages. First, the short frame requires minimal space and does not interfere with the rotation of the toner cartridges mounted to a rotary developing device in a duplication apparatus. This is particularly important for compact printers, fax machines, copiers and the like for their portability. Secondly, the short distance between the light source 28 and the light sensor 30 substantially reduces a necessary amount of light to be emitted by the light source 28. The reduced light intensity prolongs the life of the light source 28. Thirdly, the short distance allows the light source 28 and the light sensor 30 to be accurately aligned. For example, if the light source 30 is misaligned by a few degrees with respect to two light sensors that are placed at different distances from the light source, the same misaligned light would more likely hit the closer light sensor than the distant light sensor. These and other advantages increase the accuracy for detecting the toner end condition. Although some of the above described advantages may be gained by specially constructed toner cartridges, the current invention is practiced with conventional unmodified disposable toner cartridges.

Figure 4:
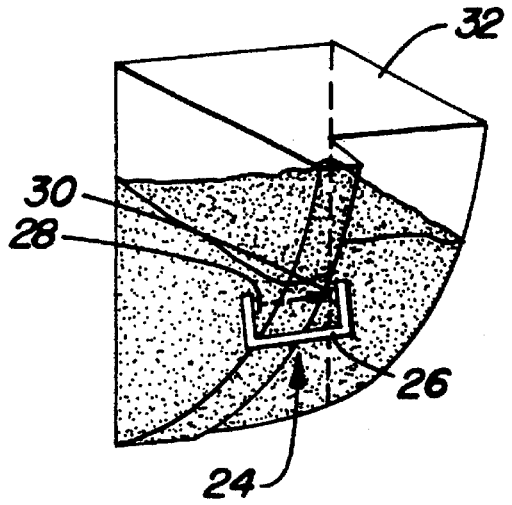
FIG. 4 is a perspective view of an alternative embodiment of the invention and illustrates a more detailed view of a toner cartridge and a detection device.

Now referring to FIG. 4, a specially constructed toner cartridge 32 and the detection device 24 are shown. Although this embodiment provides the above described advantages, the toner cartridge 32 must have a predetermined narrow edge. Such specially constructed toner cartridges generally hinder interchangeability of disposable cartridges.

Figure 5:
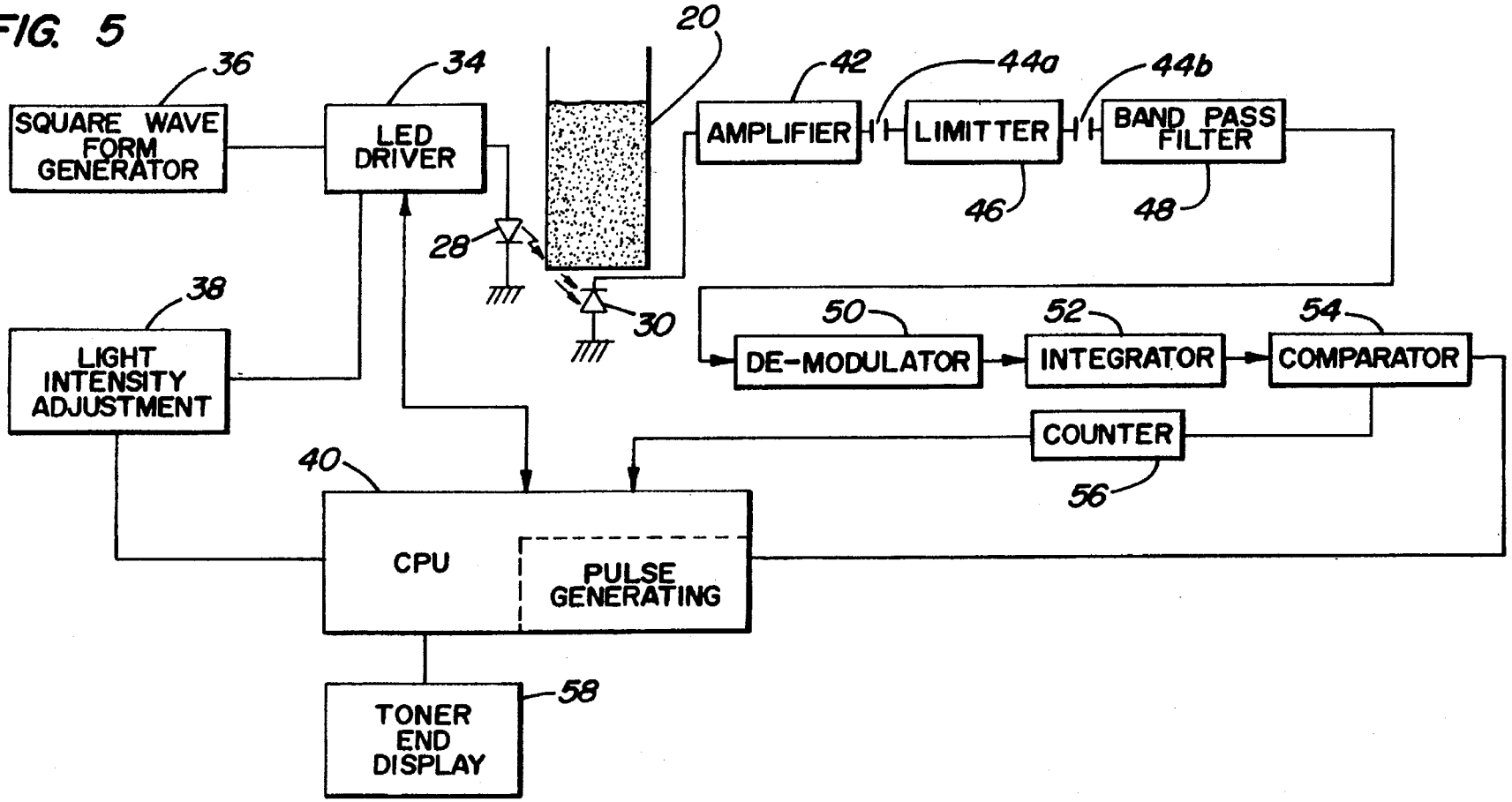
FIG. 5 is a schematic diagram of a detection circuit according to the current invention.

Referring to FIG. 5, the light source or LED 28 is controlled by a LED driver 34 which receives its inputs from a square wave generator 36 and a light intensity adjustment unit 38. The LED driver 34 and the light intensity adjustment unit 38 are also connected to the CPU 40. The light sensor or photodiode 30 outputs to an amplifier 42 connected to a limiter which is serially connected a pair of capacitors 44*a*, 44*b* at its input and output sides. Then, the output of the limiter 46 is serially connected to a band pass filter 48, a demodulator 50 and an integrator 52 for comparing the band pass filter output to a content of a counter 56 by a comparator 54. Both the counter 56 and the comparator 54 are connected to the CPU 40. The result of the computation by the CPU is indicated by an toner end indicator 58.

Still referring to FIG. 5, the light detected by the light sensor 30 is further discriminated by a frequency band pass filter 48. According to one preferred embodiment of the current invention, to increase accuracy of the toner end detection, light is emitted at a predetermined unique frequency for each toner cartridge. The band pass filters 48 uniquely discriminate the emitting frequency to increase the accuracy of the light detection, and to minimize or prevent interference from ambient light.

Figure 6A:
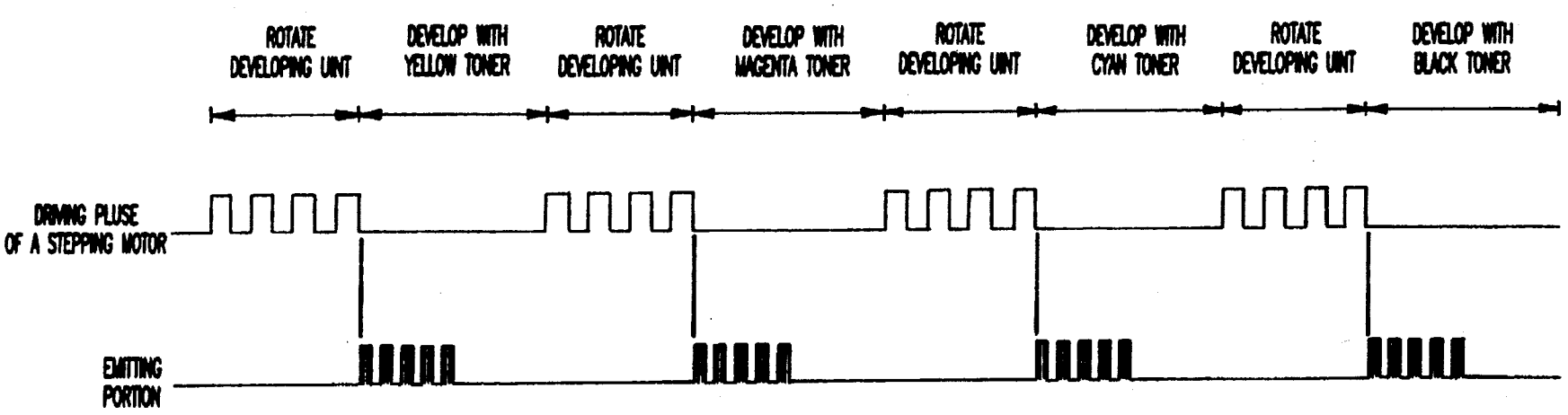
FIG. 6A is a timing diagram for the end detection system circuit of FIG. 5.
Figure 6B:
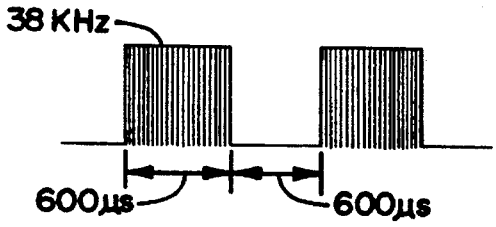
FIG. 6B is an example of LED driving signals.

Referring to FIG. 6A, a timing diagram shows the operation of the instant toner end detection system and method for each toner cartridge. According to one preferred embodiment, toner end detection takes place during a developing process after each rotation. For example, after a toner cartridge containing yellow toner is rotatably positioned to the developing position in response to a series of motor stepping pulses as labelled as "the driving pulse of a stepping motor," the yellow toner is applied to a photoreceptor drum. During this application process, the light source 28 emits a predetermined amount of light in response to a series of LED driving signals as labelled as "the emitting portion." The LED driving signals include 600-μsec bursts of 38 KHz pulses with a 600 μsec interval in-between, as shown in FIG. 6B. However, the intensity and frequency of the light may be varied depending upon the toner color in a toner cartridge as well as the transparency of the toner cartridge. In general, if the toner color is darker, it is preferred to transmit light at a higher intensity and higher frequency. By the same token, if the toner cartridge is less light transmitting, it is preferred to transmit light at a higher intensity and/or higher frequency.

Still referring to FIG. 6A, after the yellow toner cartridge detection, the magenta toner cartridge is rotatably positioned into the developing position in response to another series of the stepping motor pulses. Then, while the magenta toner is used, the toner end detection for the magenta toner cartridge takes place similarly as described above. As a second embodiment of the above described end detection device, toner end detection may take place while the toner cartridges are being rotated. Although not shown, correctly timed bursts of light would be emitted from the light source to the moving toner cartridge for detecting the presence of toner. This operation may be more efficient since it does not interrupt the operation of the developing units. However, the detection process is technically more difficult, and as a result the detection result may not be as accurate as the above described stationary detection at the developing position.

Figure 7:
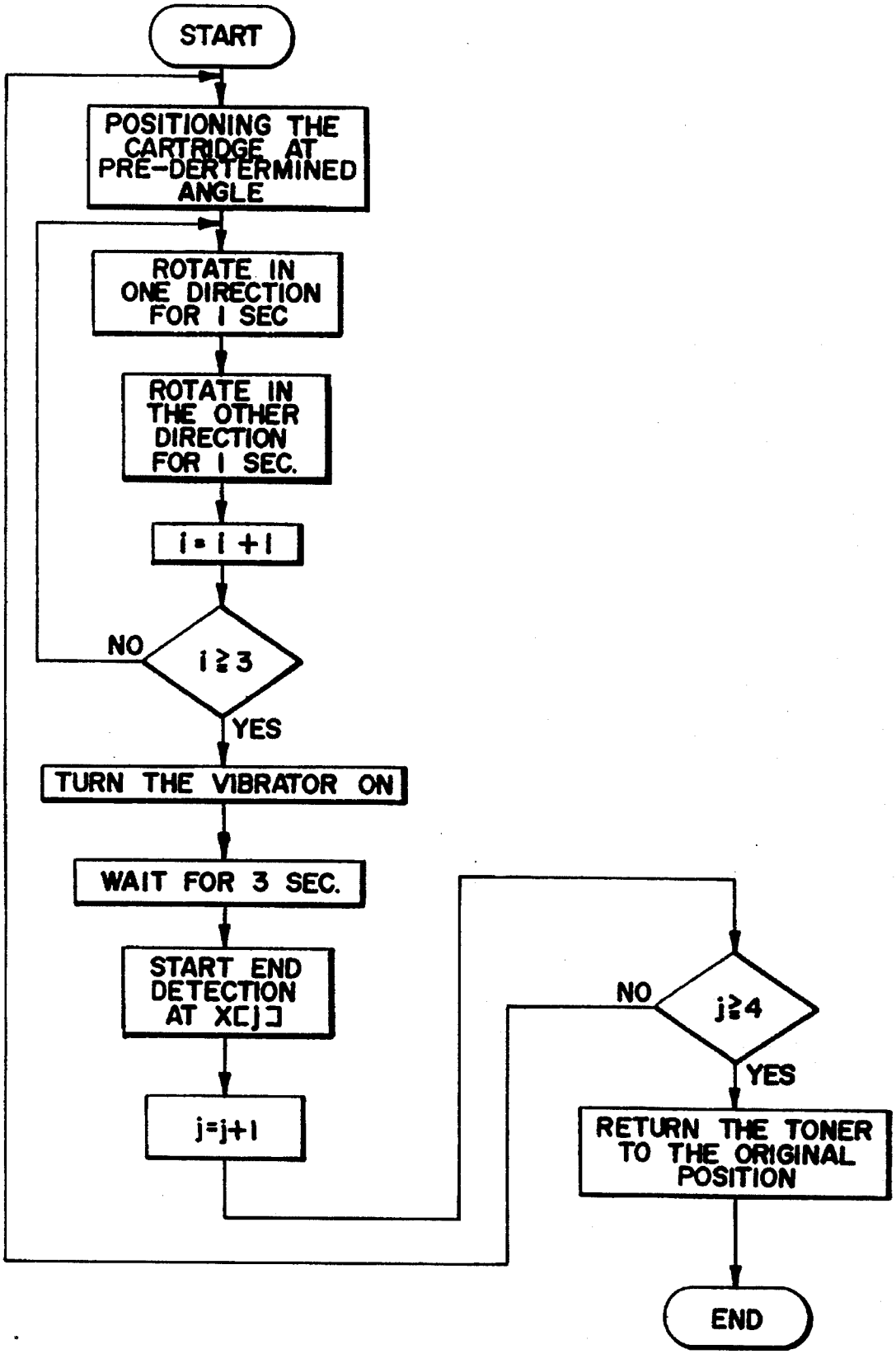
FIG. 7 is a flow chart illustrating a method for determining the amount of toner remaining in a toner cartridge according to one embodiment of the present invention.
Figure 9B:
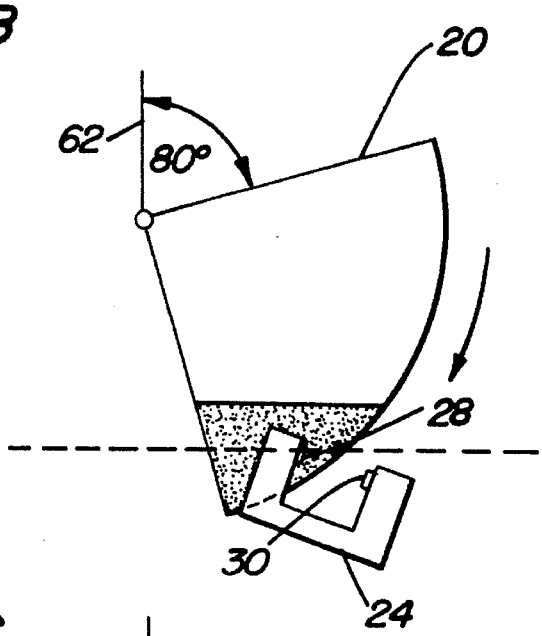
Figure 9C:
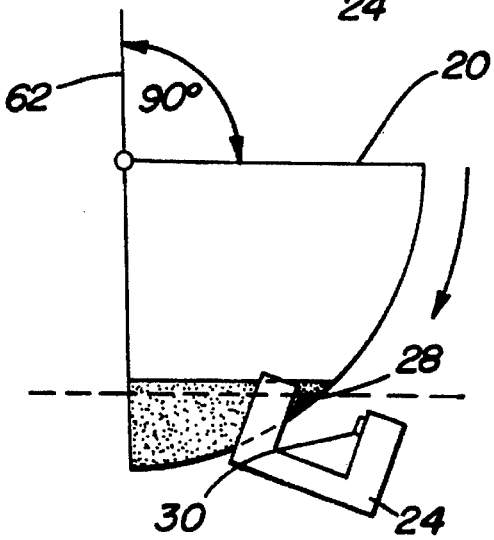
Figure 9D:
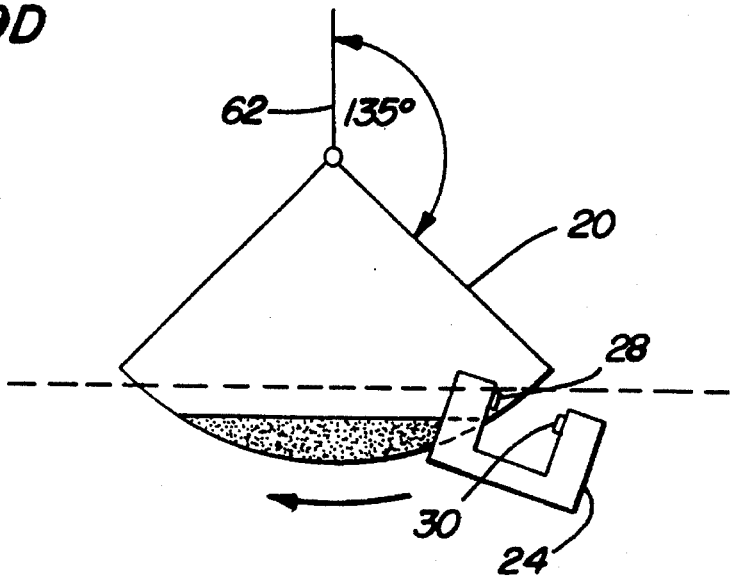

Referring to FIG. 7, the flow chart illustrates a two-step process for determining an amount of toner remaining in the toner cartridge 20. The first step includes removal of toner stuck on inner surfaces of an empty toner cartridge so as avoid inaccurate measurements. The second step includes emitting light and sensing the light at the predetermined angles. According to one preferred embodiment, toner end detection is performed at four different angular positions with respect to the detection device for each toner cartridge. Based upon the results from the four detections from one toner cartridge, the amount of remaining toner is determined. Until this process is completed, any on-going activity is suspended.

Still referring to FIG. 7, the amount of remaining toner is determined by repeating the following steps for each detection. Step 1 involves the determination of the current angular position of the developing device based upon the stepping motor pulses. After storing the current angular position, the toner cartridge is positioned at a predetermined detection angle. In Step 2, the toner cartridge is rotated clockwise for one second. In Step 3, the toner cartridge is rotated counter clockwise for one second. Step 4 determines that Steps 2 and 3 are repeated three times. In Step 5, the solenoid is turned on to activate the vibrator to further remove toner on the empty wall for a predetermined duration. After the vibrator has been switched off, the toner cartridge is left alone for three seconds in Step 6 so that the dust in the cartridge settles. In Step 7, the toner cartridge is returned to the predetermined angle with respect to the detection device 24 by sending stepping motor pulses. The light is emitted from the light source 28 towards the toner cartridge at a predetermined oblique angle as described above. The light sensor 30 detects the existing light if the toner cartridge at that angle allows light to reach the light sensor 30. After the detection, the next detection angle is selected in Step 8, and Steps 1–7 are repeated. When toner end detection is determined to have been completed for each predetermined detection angle in Step 9, the toner cartridge is positioned back to the original position before this process started in Step 10.

Figure 8:
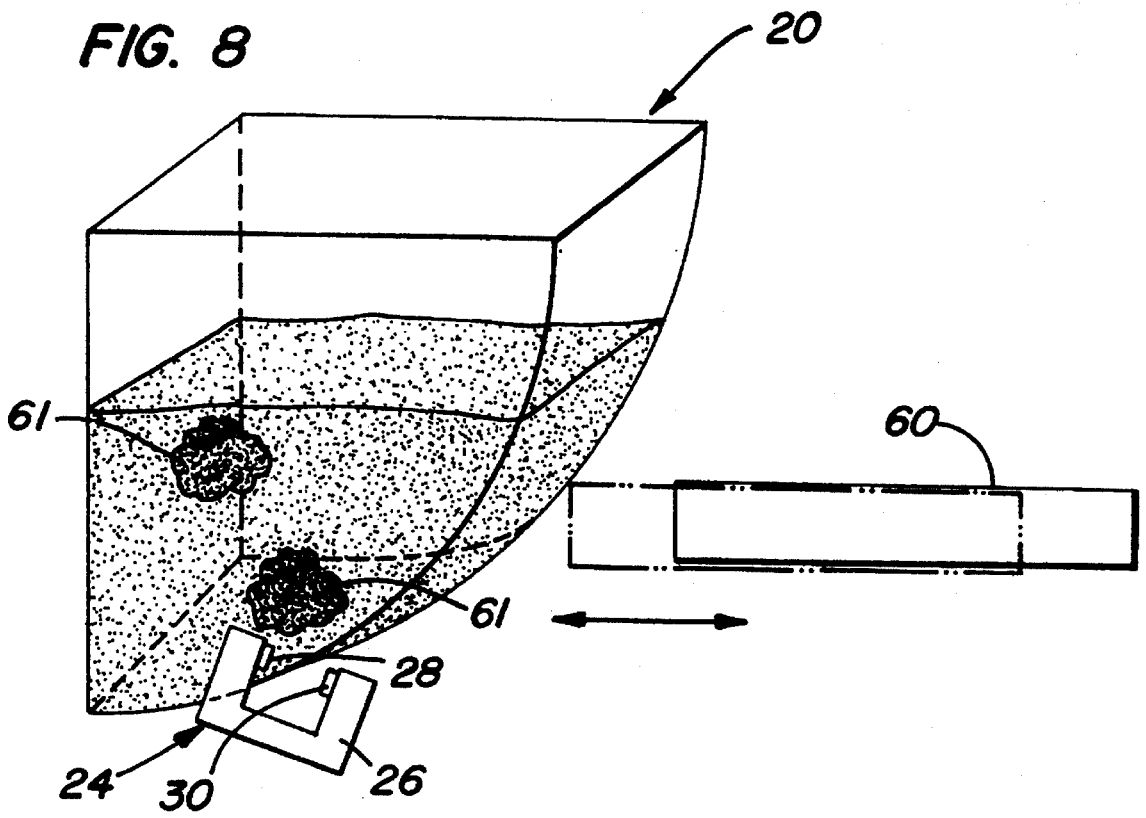
FIG. 8 is a detailed perspective view illustrating the arrangement of the toner cartridge, the detection device and a vibrator, according to the present invention.

Referring to FIG. 8, the vibration mechanism used in Step 5 of FIG. 7 includes a vibrator 60 which contacts the toner cartridge 20 and vibrates the whole toner cartridge 20 in rapid motion. Toner remaining on an empty wall is shaken off so as to reduce the opaqueness of the toner cartridge. This increased transmitting capability in a toner cartridge substantially reduces false negative readings by the light sensor.

Referring to FIG. 9, one example of the predetermined detection angles include 60°, 80°, 90° and 135° angular positions of the toner cartridge 20 with respect to the vertical line 62. However, these detection angles are merely exemplary and depend upon the shape of the toner cartridge and the position of the detection device 24 and so on. According to this example, when the remaining toner in the toner cartridge 20 is close to the toner end condition as shown in FIG. 9A–9D, the detection device 24 does not detect the toner end condition in the toner cartridge at 60°, 80° and 90°. At these angles, the emitted light from the light source 28 is blocked by toner and is not detected by the light sensor 30. At 135°, however, the toner detection device 24 detects the toner end condition since the emitted light by the light source 28 is not blocked by toner and is detected by the light source 30. Thus, based upon the number of detected toner end conditions at various angles, the remaining amount of toner is determined.

Figure 10:
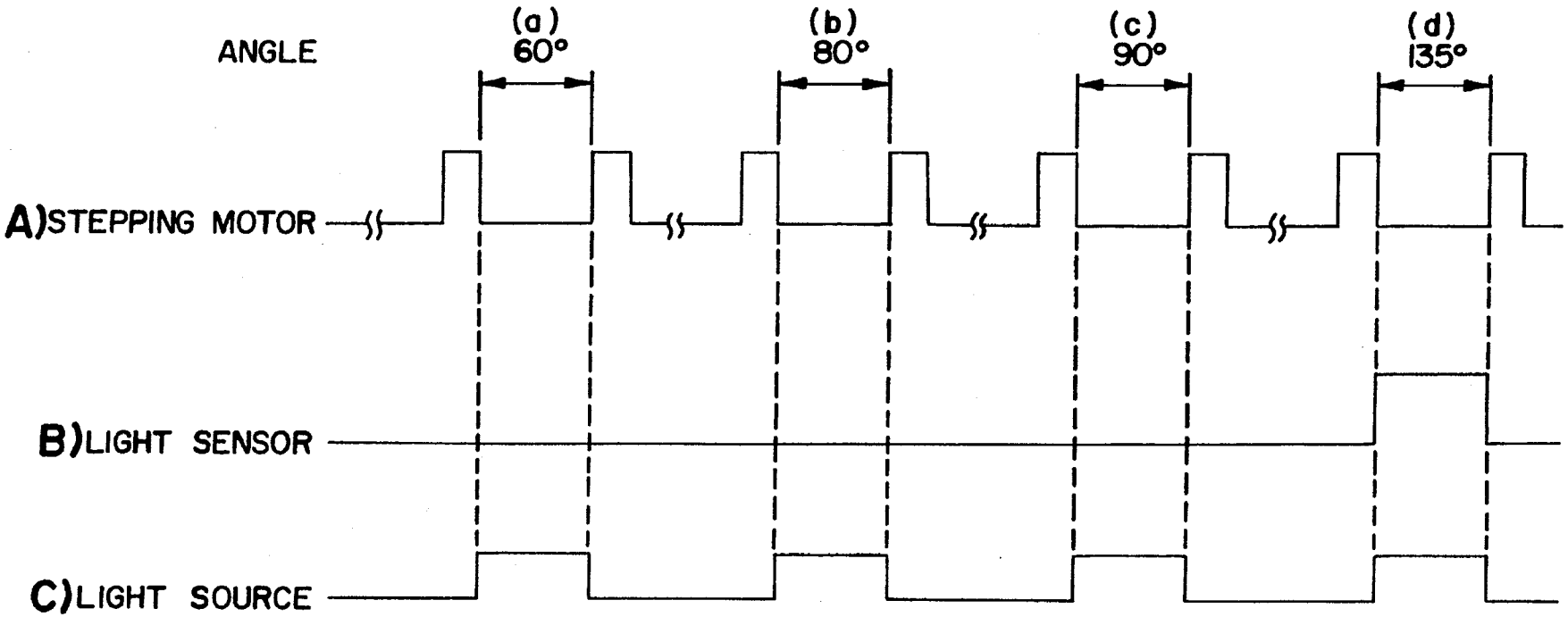
FIG. 10 is a timing diagram pertinent to FIG. 7 and illustrates the timing for actuating certain components utilized in carrying out the method of FIG. 7.

Referring to FIG. 10, a timing diagram illustrates the temporal activation of a stepping motor, the light source and the light sensor, as respectively shown by lines A, B and C. to detect the remaining amount of toner in the toner cartridge 20. The stepping motor is activated to rotate the toner cartridge from one of the predetermined detection angles. When the toner is positioned at one of the detection angles, the light source is activated. Then, the toner cartridge is further rotated to another of the predetermined detection angles. According to the above-described example as shown in FIG. 9, FIG. 10C shows that the light sensor detects the emitted light only when the toner cartridge is positioned at 135°.

Referring to FIG. 11A, a status indicator on the duplicating device indicates the amount of toner remaining, as determined by the above described process. For example, if four LED's are used as the indicator, and the toner cartridge is quarter full, one of the four LED's would be lit to indicate a one-quarter full toner cartridge. This type of indicator warns an operator about a near toner end condition in advance to secure undisturbed operation by replacing the toner cartridge.

Referring to FIG. 11B, another indicator indicates that the detection apparatus is performing a toner detection process so that other operations (e.g., copying) may be suspended until the toner detection process has been completed.

Referring to FIG. 12, after the toner end detection process has been completed, the detected empty toner cartridge is rotated to a predetermined position for replacement or replenishment. In the shown example, the toner cartridge is positioned closest to the top portion of a duplicator housing. To access the empty toner cartridge, an access door 64 is opened, and in the case of a disposable toner cartridge, the toner cartridge 20 is taken out from the duplicator housing through the door area. A new full toner cartridge of the correct type and color is then placed at the same position. The door 64 is then closed to complete the replacement of the empty toner cartridge.

Figure 13A:
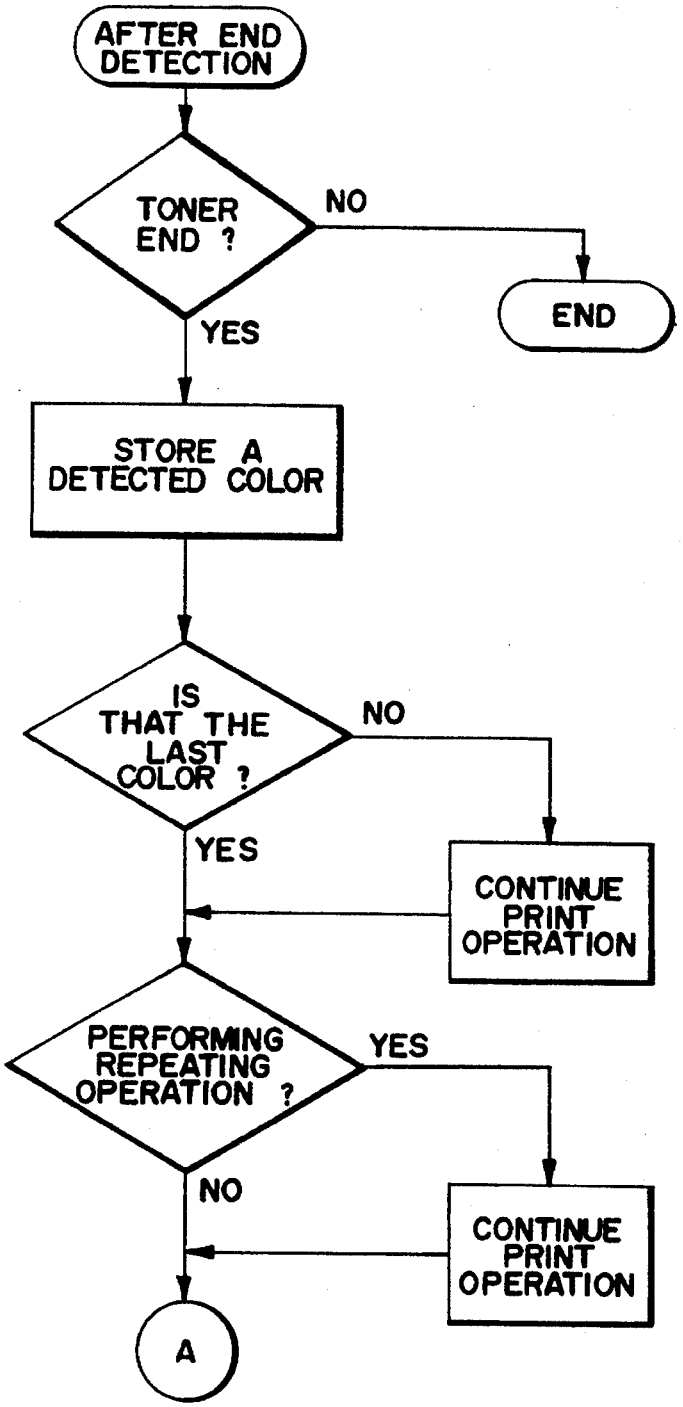
FIGS. 13A and 13B are a flow chart illustrating a method that is carried out according to the present invention after an end detection process has been completed.

Referring to FIG. 13A, after the toner end detection process has been completed, if the toner cartridge is determined to be "not empty," no additional processing is necessary. However, if a toner end condition ("empty") is detected, the color of toner in the empty toner cartridge is determined. In the next step, it is determined whether this detected color is the last color in the four-color combination sequence (i.e., a predetermined color application sequence among cyan, magenta, black and yellow). If the detected color is not the last color, the developing process which was taking place before the detection process started is resumed. On the other hand, if the detected color is the last color, then it is further determined whether this detected color is in the process of being repeatedly applied. If the detected color is repeatedly applied, this application is resumed.

Figure 13B:
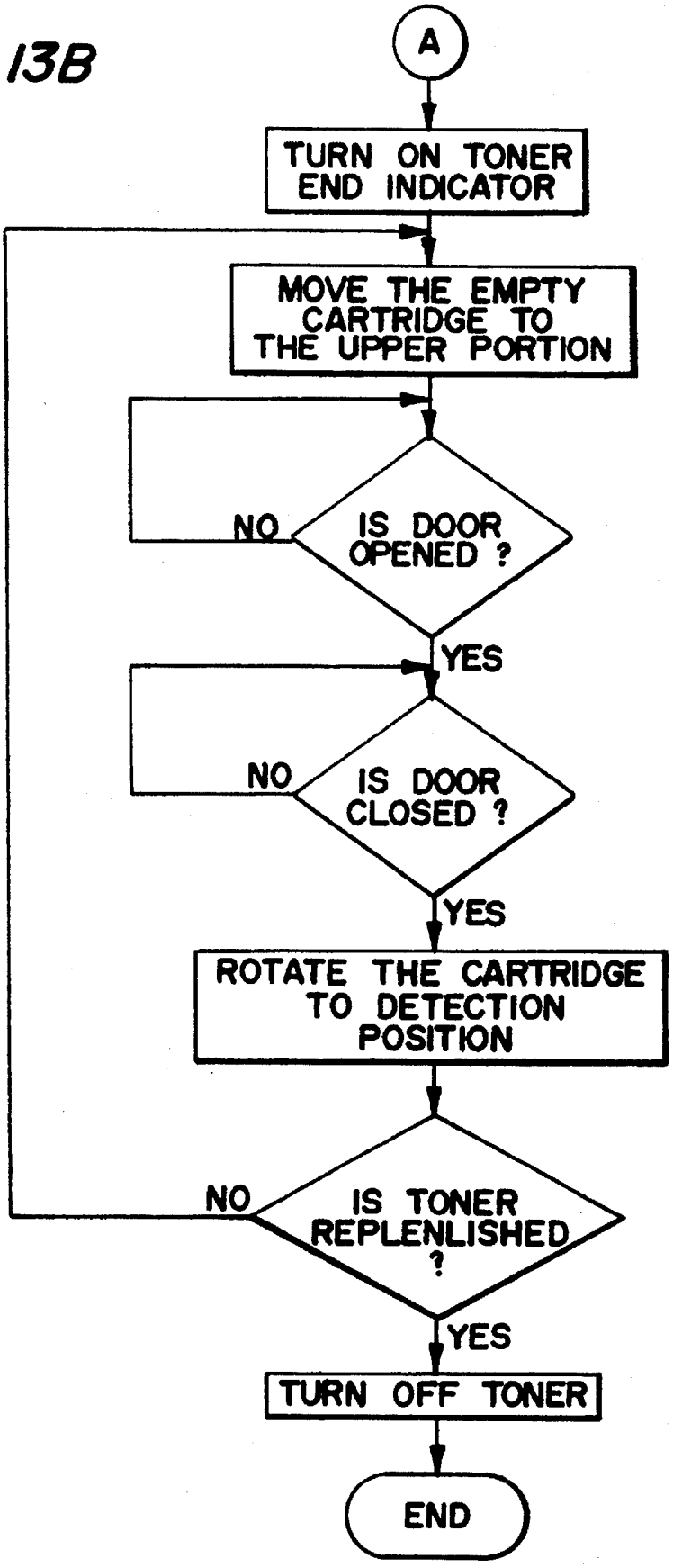

Now referring to FIG. 13B, when the application of the last color is completed, the toner end indicator is turned on. Preferably, this toner end indicator should also indicate the correct color for the refill toner cartridge. Then, the detected empty toner cartridge is rotated to a predetermined position for replacement. If a door for accessing the replacement position is opened and then closed, the detection system assumes that the empty toner cartridge has been replaced with a full one, or that the empty cartridge has been filled. The new toner cartridge is then rotated to a detection position for detecting the presence of newly supplied toner. Preferably, in addition to the mere presence of toner, the confirmation process should also ascertain the correct color of the toner. If no toner is detected, the steps starting from rotating the detected toner cartridge to the predetermined replacement position are repeated. When the correct replaced toner has been confirmed, the toner end indicator is turned off.

To ensure or ascertain that a correct toner cartridge has been replaced, a toner cartridge may have machine identifiable identification. As an example, the toner cartridge may have a bar code or some type of machine readable information for ascertaining that a correct toner cartridge has been placed in the holding area. As another example, a portion of the shape of the toner cartridge may be unique for each color or toner type so that when a wrong toner cartridge is inserted for replacement, it does not fit in the toner cartridge holding area.

It is to be understood that, even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An end detection system for a duplicating device comprising:

a toner cartridge mounted to a rotary developing device, said toner cartridge having a first wall, a second wall and a common edge formed by said first wall and said second wall, at least a portion of said first wall and said second wall adjacent said bottom edge being substantially light transmissive;

a light source located adjacent to said common edge for emitting a predetermined amount of light into said toner cartridge at a predetermined oblique angle with respect to said first wall and towards said second wall; and a light sensor located adjacent adjacent to said common edge for detecting light exiting from said toner cartridge, said light being detected on only when said toner cartridge is in a substantially empty condition, said light sensor generating an output indicative thereof.

2. The system according to claim 1 wherein said light source and said light sensor are fixedly located at predetermined positions.

3. The system according to claim 2 further comprising:

a light emitting controller connected to said light source for controlling said light source; and a decision unit responsive to the output of said light sensor for detecting whether said substantially empty condition exists when said toner cartridge is in a predetermined position.

4. The system according to claim 3 wherein said toner cartridge is rotatable with rotation of the rotary developing unit and wherein said light emitting controller causes said light source to repeatedly emit said light while said toner cartridge is being rotated, and said light sensor detecting said light at different angular positions of said toner cartridge, said decision unit detecting whether said substantially empty condition exists at each such angular position based upon said output to provide an indication of the amount of toner remaining in the toner cartridge.

5. The system according to claim 3 wherein said light sensor detects light from said light source when said toner cartridge has been positioned at a predetermined angle with respect to said light source.

6. The system according to claim 3 wherein said toner in said toner cartridge has a color that is one of black, yellow, cyan and magenta.

7. The system according to claim 6 further comprising a frequency bandpass filter, said light emitting controller causing said light source to emit said light at a predetermined frequency based upon said color of said toner, said frequency bandpass filter selectively responding to said light of said frequency.

8. The system according to claim 6 wherein said light emitting controller causes said light source to emit said light at a predetermined light intensity based upon said color of said toner.

9. The system according to claim 1 further comprising a vibrating device in operative contact with said toner cartridge for vibrating said toner cartridge to remove toner remaining on inside surfaces of said toner cartridge.

10. The system according to claim 1 wherein said first wall is a side wall of said toner cartridge and said second wall is a bottom wall of said toner cartridge.

11. The system according to claim 3 further comprising a stepping motor connected to said rotary developing device for rotating said toner cartridge, said stepping motor, in response to an output of said decision unit, rotatably positioning said toner cartridge that is in said substantially empty condition to a predetermined retrieval position.

12. The system according to claim 3 further comprising a warning device response to said decision unit for indicating the presence of said substantially empty condition.

13. In a duplicating device, an end detection apparatus comprising:

a plurality of toner cartridges mounted to a rotary developing device, each of said toner cartridges having a first wall, a second wall and a common bottom edge formed by said first wall and said second wall, at least a portion of said first wall and said second wall adjacent said bottom edge being substantially light transmissive, each of said toner cartridges being rotatable to a predetermined detection position, the toner cartridge in said detection position being defined as a test toner cartridge;

a light source fixedly located adjacent said test toner cartridge for emitting a predetermined amount of light towards said first wall adjacent said bottom edge at a predetermined oblique angle with respect to said first wall and into said test toner cartridge towards said second wall; and a light sensor fixedly located adjacent said bottom edge of said second wall for detecting said light exiting from said test toner cartridge, said light being detected only when said toner cartridge is in an empty condition, said light sensor providing an output indicative thereof, each toner cartridge being rotated to said detection position for detecting the presence of said empty condition.

14. The apparatus according to claim 13 further comprising:

a stepping motor coupled to said rotary developing device for rotating said rotary developing device and said toner cartridges;

a cartridge information processor for tracking the rotation of said toner cartridges and for generating an output indicating that the test toner cartridge is in said empty condition; and, a warning indicator connected to said cartridge information processor for indicating said empty condition of said toner cartridge.

15. The apparatus according to claim 13 wherein each of said toner cartridges contains a unique color toner being one of cyan, magenta, block and yellow.

16. The apparatus according to claim 15 wherein said light source emits said light at a predetermined light intensity based upon said unique color.

17. The apparatus according to claim 15 wherein said light source emits said light at a predetermined frequency based upon said unique color.

18. The apparatus according to claim 13 wherein said light source repeatedly emits said light while said test toner cartridge is rotated and said light sensor detects said light at different angular positions of said test toner cartridge to determine an amount of said toner remaining in said test toner cartridge.

19. The apparatus according to claim 13 wherein said light sensor detects said light when said test toner cartridge has been positioned to said detection position.

20. A method of detecting an empty condition in a toner cartridge mounted to a rotary developing apparatus, the toner cartridge having a first wall, a second wall and a common bottom edge formed by said first wall and said second wall, at least a portion of said first wall and said second wall adjacent the bottom edge being substantially light transmissive, comprising the steps of:

a. emitting light towards said first wall adjacent said bottom edge at a predetermined oblique angle with respect to said first wall and towards said second wall adjacent said bottom edge;

b. detecting whether light exits from said second wall adjacent said bottom edge, said light exiting when the empty condition exists; and c. determining whether said toner cartridge is substantially empty based upon step b.

21. The method as recited in claim 20 further comprises the steps of:

d. generating a signal indicative of the empty condition of said toner cartridge based upon step c;

e. warning an operator of said empty condition;

f. moving said toner cartridge to a predetermined position for replacement thereof when the empty condition has been detected; and, g. ascertaining correct placement of a replacement toner cartridge is correctly placed.

22. The method as recited in claim 20 wherein said toner cartridge contains toner of a color that is one of cyan, magenta, yellow and black.

23. The method as recited in claim 22 wherein said light is emitted at a predetermined light intensity based upon said color.

24. The method as recited in claim 22 wherein said light is emitted at a predetermined frequencies based upon said color.

25. The method as recited in claim 24 wherein step b comprises employing a frequency band filter that is selectively responsive to said predetermined frequency.

26. The method as recited in claim 20 wherein step a and said step b are repeatedly performed as said toner cartridge is rotated.

27. The method as recited in claim 20 wherein step a and said step b are performed when said toner cartridge has been rotatably positioned to a predetermined detection position.

28. A method of detecting the status of a plurality of toner cartridges mounted to a rotary developing apparatus, each of the toner cartridges having a first wall, a second wall and a common bottom edge formed by said first wall and said second wall, at least a portion of said first wall and said second wall adjacent the bottom edge being substantially light transmissive, comprising the steps of:

a. positioning one of the toner cartridges at a predetermined detection position, said toner cartridge positioned at said predetermined detection position being defined as a test toner cartridge;

b. emitting light towards said first wall adjacent said bottom edge of said test toner cartridge at a predetermined oblique angle with respect to said first wall and towards said second wall adjacent said bottom edge of said test toner cartridge;

c. detecting light exiting from said second wall adjacent said bottom edge of said test toner cartridge, said light exiting when the empty condition exists; and d. determining whether said test toner cartridge is substantially empty based upon step c.

29. The method as recited in claim 28 wherein each of the toner cartridges contains a toner of a unique color.

30. The method as recited in claim 29 wherein step d further comprises the steps of:

e. generating a signal indicative of an empty condition of said test toner cartridge based upon step d;

f. warning an operator of said empty condition;

g. rotating said test toner cartridge to a predetermined position for replacement thereof when the empty condition has been detected; and, h. ascertaining correct placement of a replacement toner cartridge.

31. The method as recited in claim 30 wherein said signal generated in said step e is further indicative of said color of said toner in said test toner cartridge.

32. A method of determining an amount of toner remaining in a toner cartridge for a rotary developing apparatus, the toner cartridge having a first wall and a second wall, comprising the steps of:

a. rotating said toner cartridge to a predetermined angular position;

b. emitting light towards said first wall of said toner cartridge when said toner cartridge has been positioned to said predetermined angular position;

c. measuring the light exiting from said toner cartridge when said toner cartridge has been positioned to said predetermined angular position;

d. rotating said toner cartridge to a different predetermined angular position;

e. repeating said steps a through c for said different predetermined angular position; and f. determining the amount of the toner remaining in said toner cartridge based upon steps c and d.

* * * * *

UNITED STATES PATENT AND TRADEMARK OFFICE

CERTIFICATE OF CORRECTION

PATENT NO. : 5,621,221

DATED : April 15, 1997

INVENTOR(S) : Tadashi Shinohara, Kouichi Noguchi, Eiichi Sasaki and Kouichi Irie It is certified that error appears in the above-indentified patent and that said Letters Patent is hereby corrected as shown below:

Column 1, line 64, change "61-08/361,151,576" to --61,151,567--.

Column 2, line 34, after "flashing" insert --of--.

Column 11, line 5, change "response" to --responsive--.

Signed and Sealed this

Twenty-seventh Day of October, 1998

*Attest:*

*Attesting Officer*

BRUCE LEHMAN

*Commissioner of Patents and Trademarks*